US006360490B1

(12) United States Patent
Cotriss

(10) Patent No.: US 6,360,490 B1
(45) Date of Patent: Mar. 26, 2002

(54) CONTAINMENT SYSTEM

(76) Inventor: Richard J Cotriss, 114 Brair La., P.O. Box 601, Tipton, MO (US) 65081

( * ) Notice: Subject to any disclaimer, the term of this patent is extended or adjusted under 35 U.S.C. 154(b) by 0 days.

(21) Appl. No.: 09/883,059

(22) Filed: Jun. 15, 2001

(51) Int. Cl.[7] ..... E04B 1/34

(52) U.S. Cl. ..... 52/2.13; 52/2.18; 52/138; 52/2; 52/218

(58) Field of Search ..... 52/2.13, 2.18, 52/2.25, 2.26, DIG. 12

(56) References Cited

U.S. PATENT DOCUMENTS

| | | | | | |
|---|---|---|---|---|---|
| 3,762,108 | A | | 10/1973 | Pierson | |
| 3,893,268 | A | | 7/1975 | Bird | |
| 4,128,973 | A | * | 12/1978 | Robinson | 52/2 |
| 4,477,503 | A | | 10/1984 | Fraioli | |
| 5,011,710 | A | | 4/1991 | Harrison | |
| 5,247,768 | A | * | 9/1993 | Russo | 52/213 |
| 5,291,695 | A | | 3/1994 | Healy et al. | |
| 5,367,841 | A | | 11/1994 | Smith et al. | |
| D361,364 | S | * | 8/1995 | Winters | |
| D363,993 | S | * | 11/1995 | Johnson et al. | D25/19 |
| 5,481,832 | A | | 1/1996 | Tirikos | |
| 5,484,035 | A | | 1/1996 | Wildner | |
| 5,570,544 | A | * | 11/1996 | Hale et al. | 52/218 |
| 5,634,528 | A | | 6/1997 | Watts | |
| 5,688,323 | A | | 11/1997 | Kane et al. | |
| 5,761,852 | A | * | 6/1998 | Liu | 52/2.18 |
| 5,785,148 | A | * | 7/1998 | Wildner | 182/138 |
| 5,911,288 | A | | 6/1999 | Zafirakis | |
| 5,918,438 | A | | 7/1999 | South | |
| 6,070,366 | A | | 6/2000 | Pierson | |
| 6,070,371 | A | | 6/2000 | Myrick | |

* cited by examiner

*Primary Examiner*—Carl D. Friedman
*Assistant Examiner*—Steve Varner
(74) *Attorney, Agent, or Firm*—Richard Grundstrom

(57) ABSTRACT

The containment system of this invention is an enclosure that includes an air supported canopy having walls and flooring to enclose a portion or an entire structure. The canopy is generally a flexible, puncture, air impermeable, and cut resistant canopy supported by air beams and customized air bladders. Side and end flaps or tarps hang downward from the canopy and may be held outward from the structure by air bags. The air bladders are used to support the enclosure above the structure and to hold side flaps out and away from the structure. Lower air bladders can be used along lower edges if needed. A system of wire cables enclosed in smooth, lightweight casings, or equivalent, attached and secured to the air bladders provides for movement of the enclosure along the structure. The entire enclosure can be moved without disassembly and reassembly.

17 Claims, 9 Drawing Sheets

CONTAINMENT SYSTEM

BACKGROUND OF THE INVENTION

The present invention relates to a containment system and more particularly to enclosures used to contain contaminants generated when applying or removing coatings on structures. More specifically, it is an inexpensive enclosure that will reduce the time needed for installation and movement along structures, such as bridges, large buildings, and other structures while containing environmental contaminants.

Containment systems are used for many different purposes. One such use is for containment of contaminants being removed from structures, such as bridges, buildings, and other large structures. The containment of the contaminants is, obviously, for preventing the spread of the contaminants into the environment. Contaminants being removed which must be contained commonly include lead based paints, asbestos, and other hazardous or potentially hazardous materials.

Most types of enclosures presently known and used in the art are canvas tarps hung from the structure by wire cables and/or metal and wood frames attached to the structure. A roof is made by suspending a canvas tarp over some sort of frame made from metal or wood. As work progresses along the structure the tarps, cables, and frame(s) must be removed and replaced section by section. This prior method is labor intensive and time consuming.

Typically, enclosures for bridges and large structures are made by first constructing a rigid frame generally attached to the structure. Canvas or other types of tarps are hung downward from an upper frame structure along the sides of the structure. A roofing frame, with or without cables, supports additional canvas or tarps to cover the top. Another frame structure, if used, holds the canvas away from the working area on the sides of the structure. Lower tarps or canvas are attached to lower ends of the downward hanging tarps or canvas and are suspended and hanging below the bridge. End tarps are attached to both ends to complete the containment system.

In conventional enclosures, tarps are also used "flush" with the structure which causes tearing of the tarps when exposed to high winds. The tarps of the past were typically made of canvas or similar materials, which is heavy and require substantial cables and framing for support. Plus, they generally absorb or retain moisture over time. Additionally, using the tarps and methods of the past, controlling air infiltration has been a problem. The previous known art would have many "leaks" through rips, tears, patches and areas where tarps are joined. The present invention provides a water resistant, air impermeable enclosure in which air infiltration is substantially reduced or eliminated. As such, expenditures for large over sized dust collectors to compensate for air infiltration are greatly reduced.

Tarps of the prior art were mounted to rigid frames and cabling. During high winds, the tarps capture large quantities of wind like a sail. The forces generated can be substantial. As a result, frames are often bent and broke due to winds. The broke and bent framing contributes to ripping and puncturing tarps. On the other hand, the presented invention will shift with the wind, and a puncture and cut resistant fabric will withstand the wind, other weather hazards, and work related activities that would require replacing the containment system. Plus, there are no frames to bend and break.

The containment system of this invention is designed for bridges, large buildings, and other types of large structures that in the past have been difficult to contain or cover.

Accordingly, one object of this invention is intended to reduce the time required for installation of and movement of a containment system along a structure while effectively containing environmental hazards, contaminants, or other potentially harmful matter.

Another object of this invention is the reduction in the amount of airborne contaminants to reduce worker exposure to occupational health hazards, ie lead.

An even further object of the invention is to provide an air supported enclosure that operates by using a system of cables and air bladders thereby reducing, if not eliminating punctures, rips, tears, and cuts in the containment system.

To accomplish the foregoing and other objects of this invention there is provided a containment system and more particularly to an enclosure attachable to a structure such as a bridge, which is light weight, readily attachable to the structure and easily moved along the structure.

SUMMARY OF THE INVENTION

The containment system of this invention is an enclosure that includes an air supported canopy having walls and flooring to enclose a portion or an entire structure, especially bridges. The enclosure is a containment system generally having a flexible, puncture and cut resistant canopy supported by air beams and customized air bladders. Side and end flaps or tarps hang downward from the canopy and are held outward from the structure by air bags. Air bladders are used to support the enclosure on the structure. The air bladders are generally located along edges of the structure, additional air bladders can be used along lower edges of the structure, such as with bridges, to attach lower ends of side flaps, to hold side flaps out and away from the structure and to support a bottom tarp, if used. A system of wire cables, or equivalent, enclosed in smooth, lightweight casings, a tracking means, provides for movement of the enclosure along the structure. The canopy, and side and end walls are attached to the casing. The casing can be moved by sliding along the wire cable, or equivalent to move the entire enclosure.

The above mentioned and other objects, and features of the present invention will be better understood and appreciated from the following detailed description of the main embodiment thereof, selected for purposes of illustration and shown in the accompanying drawings.

DETAILED DESCRIPTION

Figure 1:
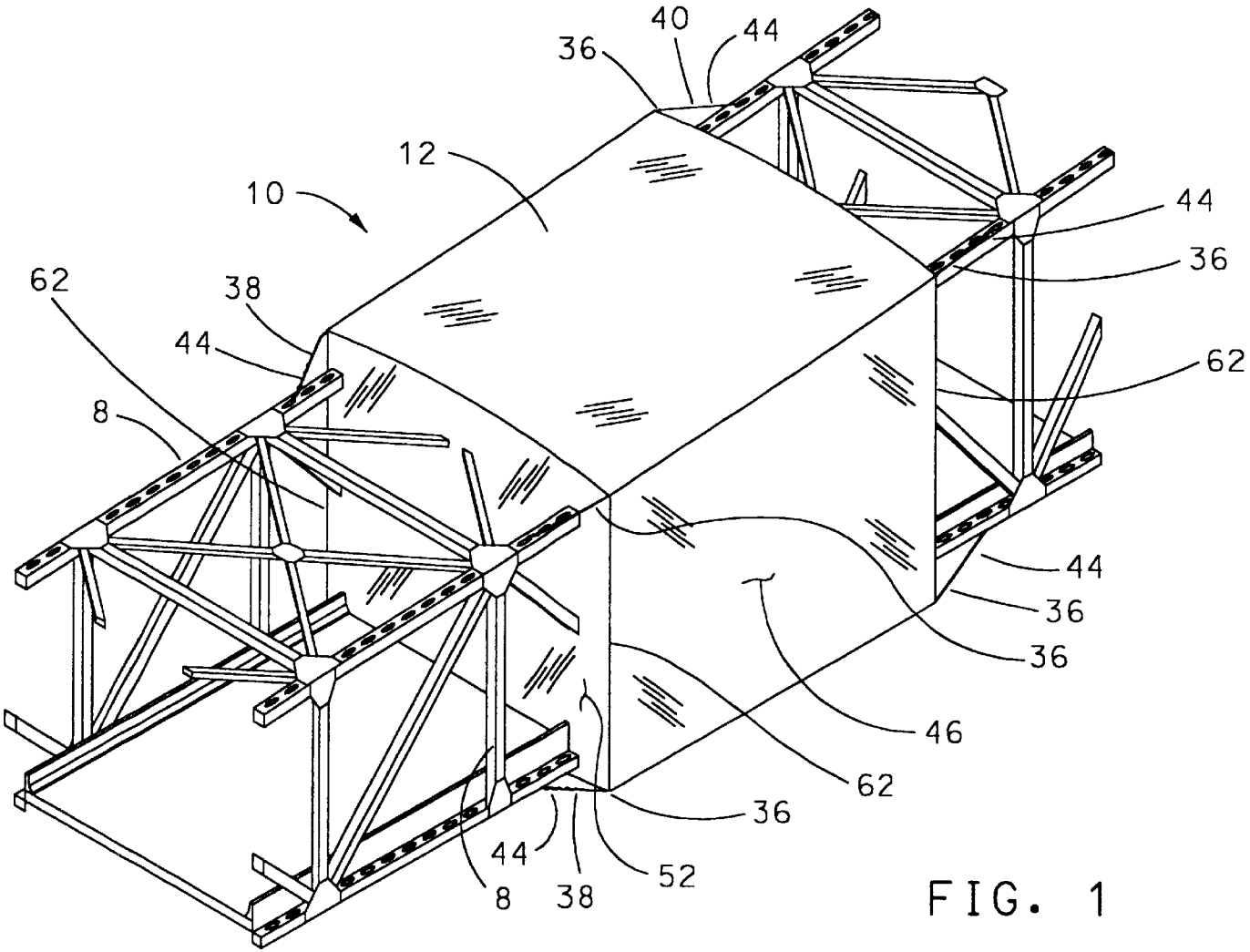
FIG. 1 is an isometric view of the enclosure installed on a bridge using a containment system of this invention.
Figure 2:
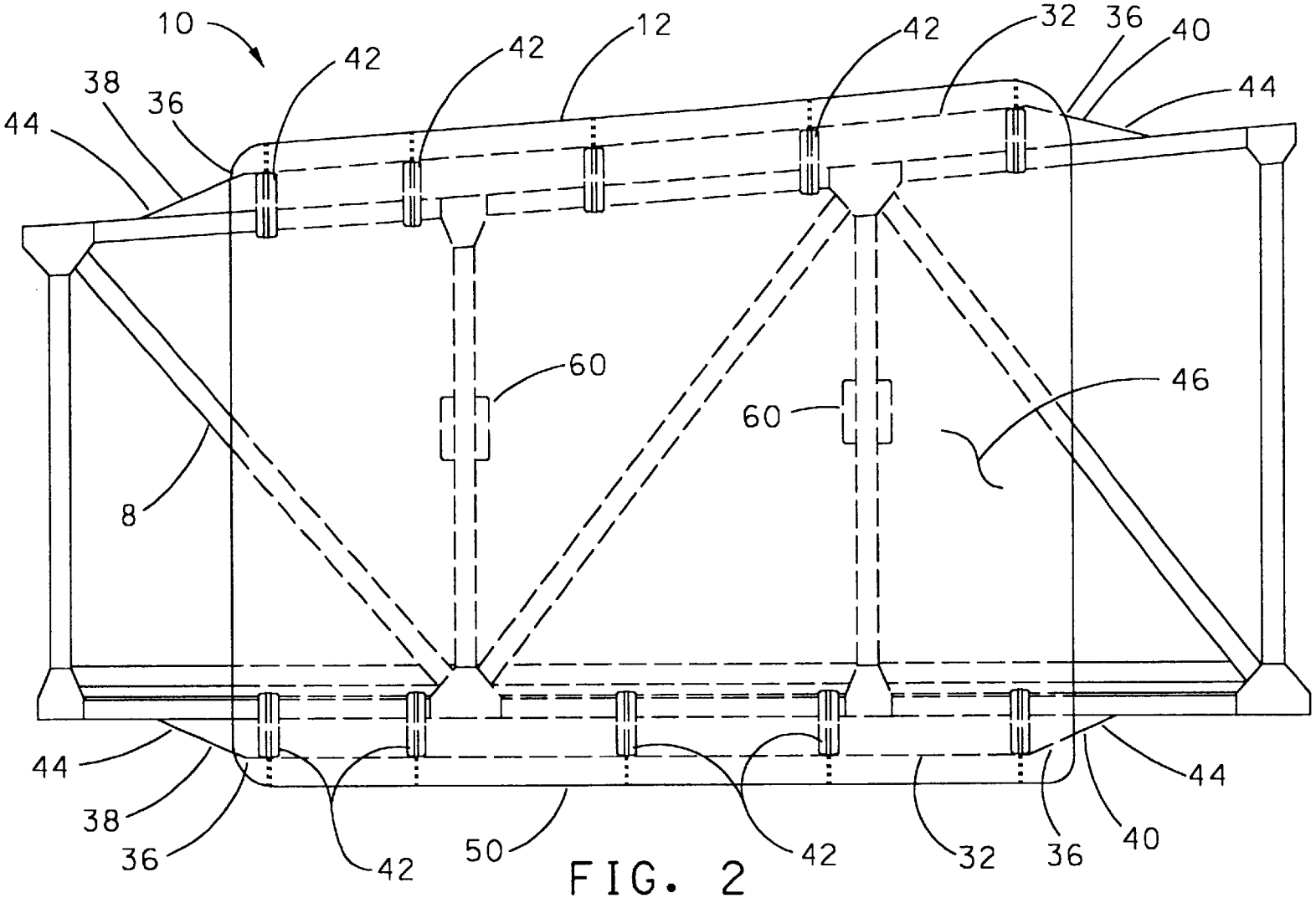
FIG. 2 is a side view showing an enclosure installed on a bridge using a containment system of this invention.
Figure 3:
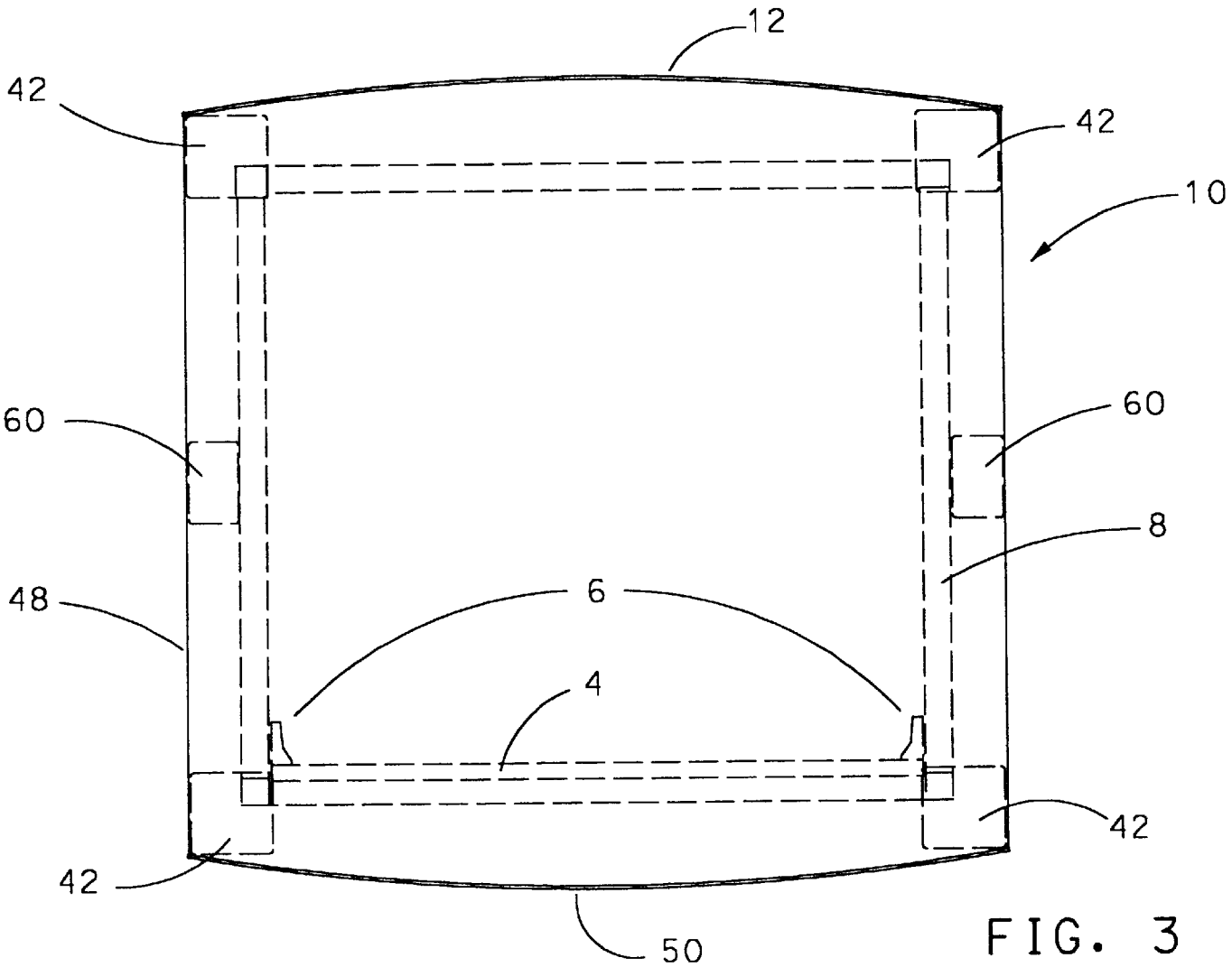
FIG. 3 is an end view showing an enclosure on a bridge using a containment system of this invention.
Figure 4:
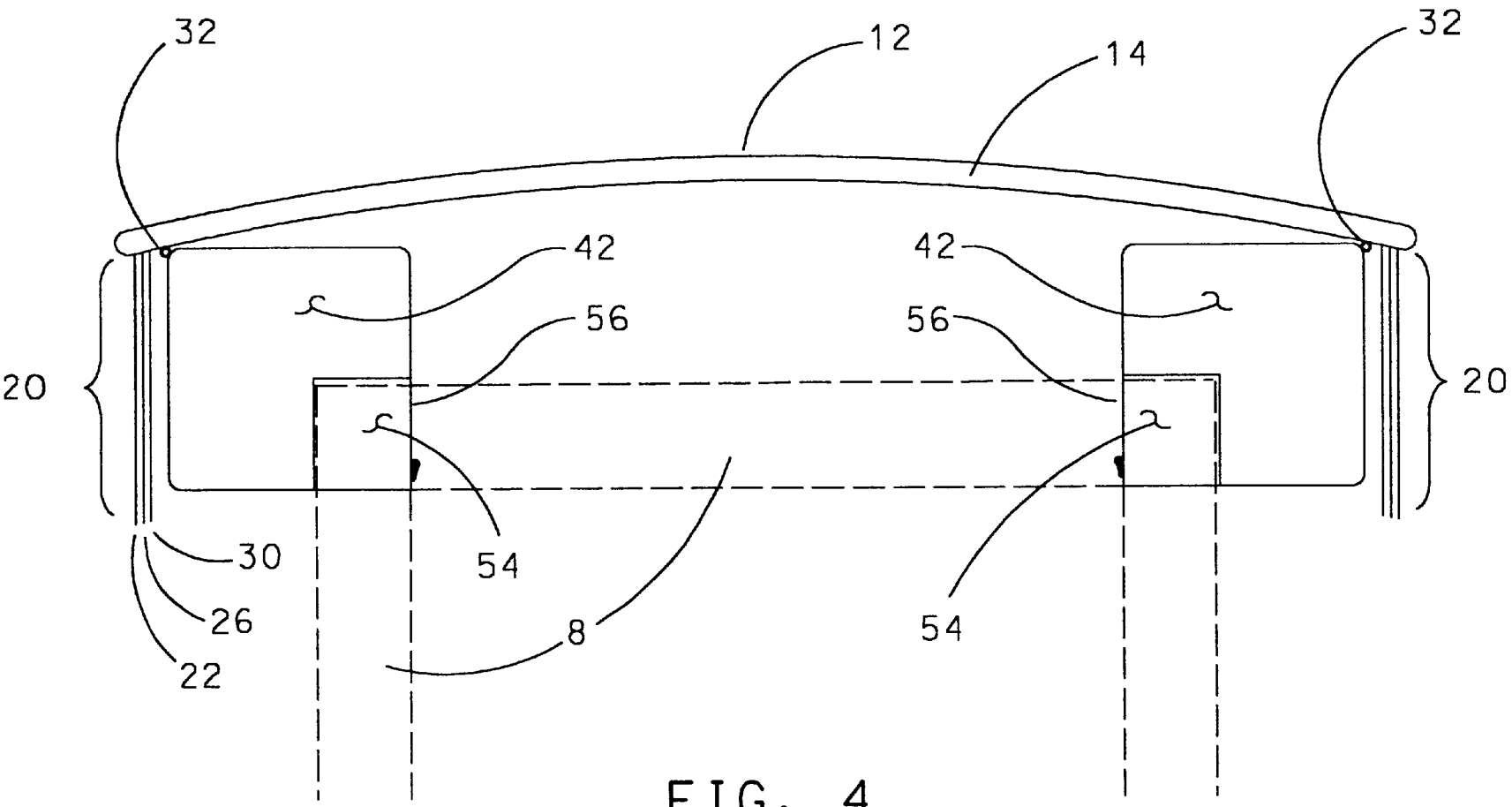
FIG. 4 is an end view showing the canopy and air bladders on top of a phantom structure.
Figure 5:
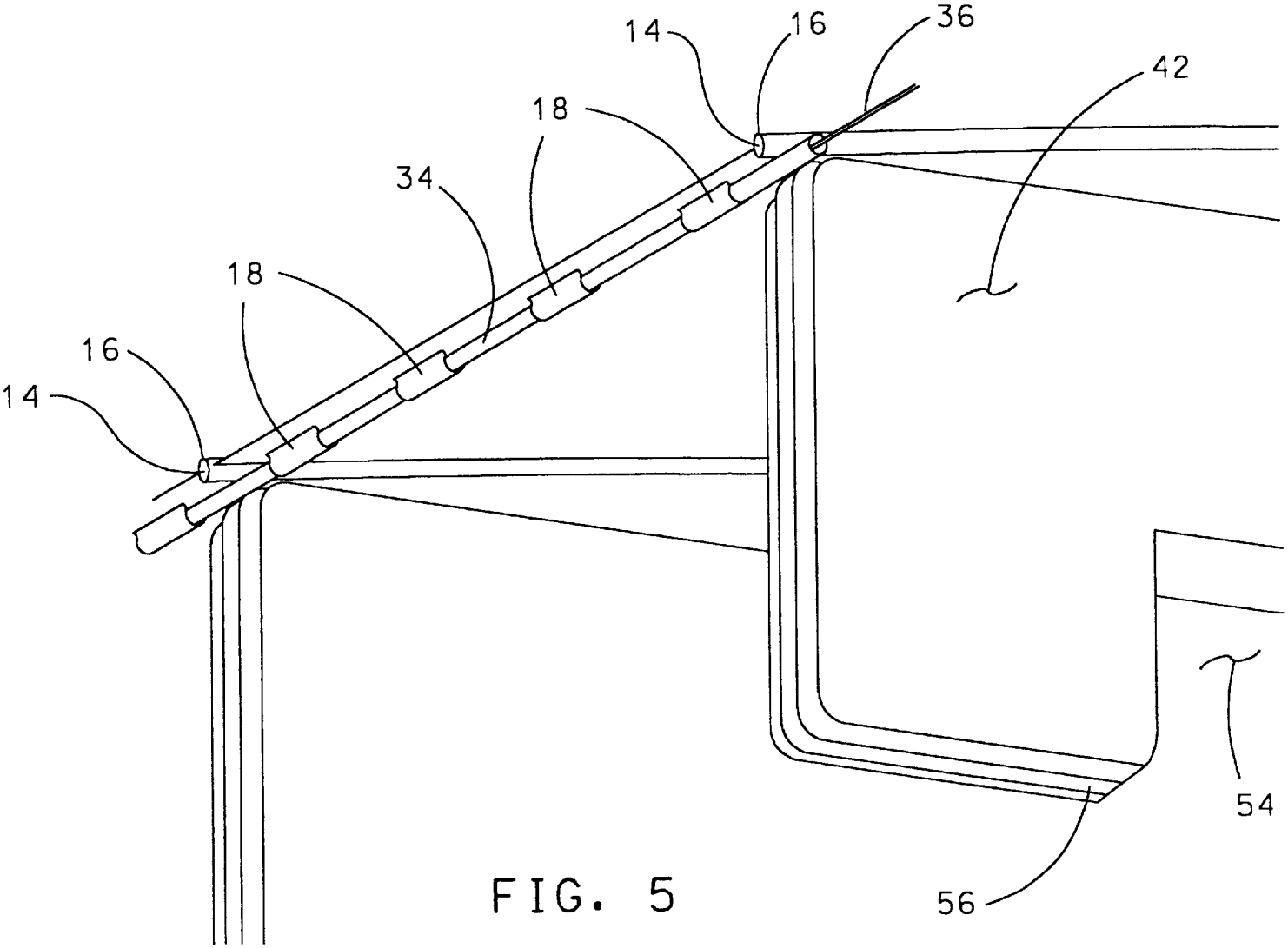
FIG. 5 is a partial bottom view showing the air bladder and canopy with a tracking means used to move an enclosure along the structure.
Figure 6:
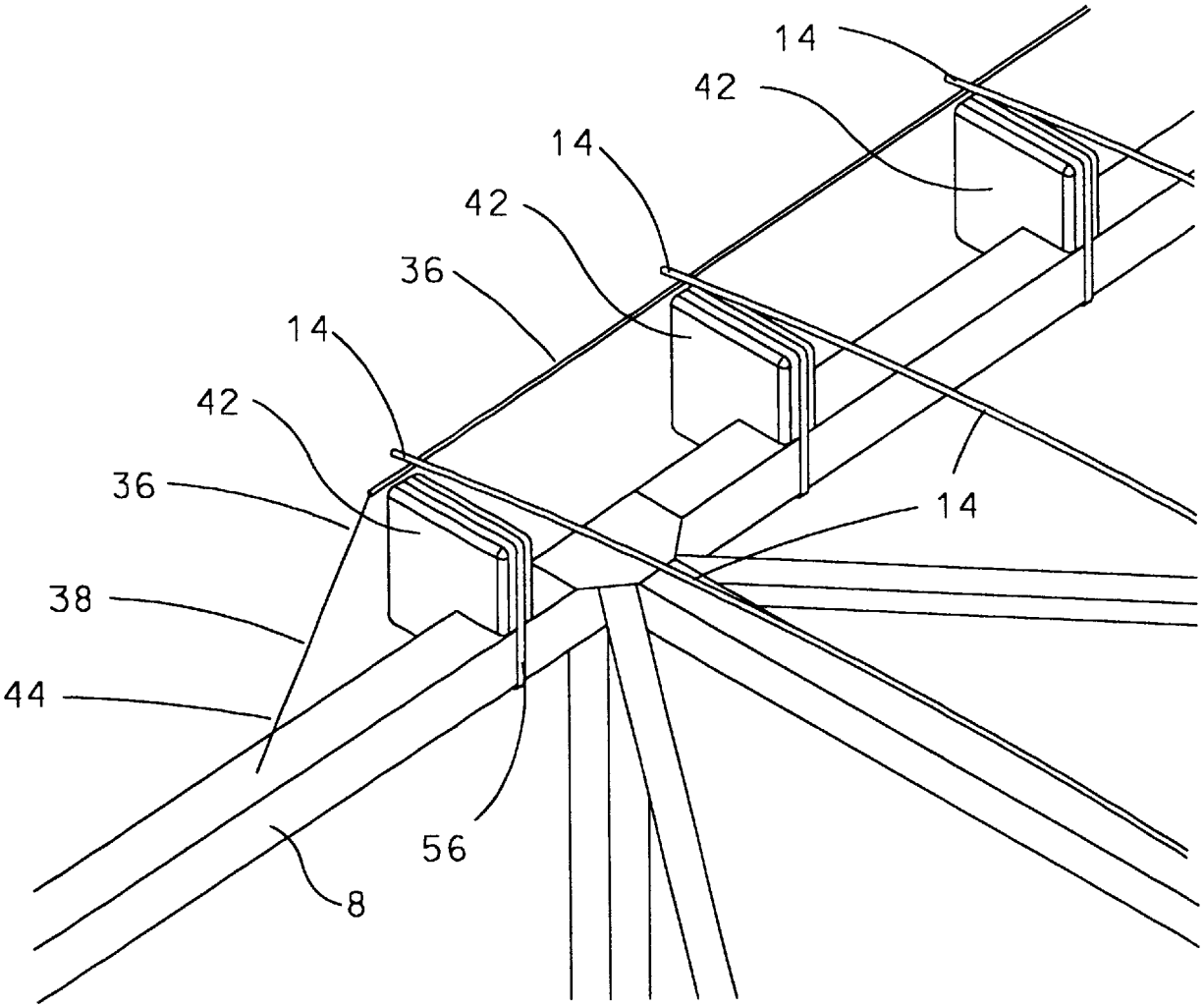
FIG. 6 is another view showing the canopy in phantom, air beams, air bladders, and tracking means attached to a structure.
Figure 7:
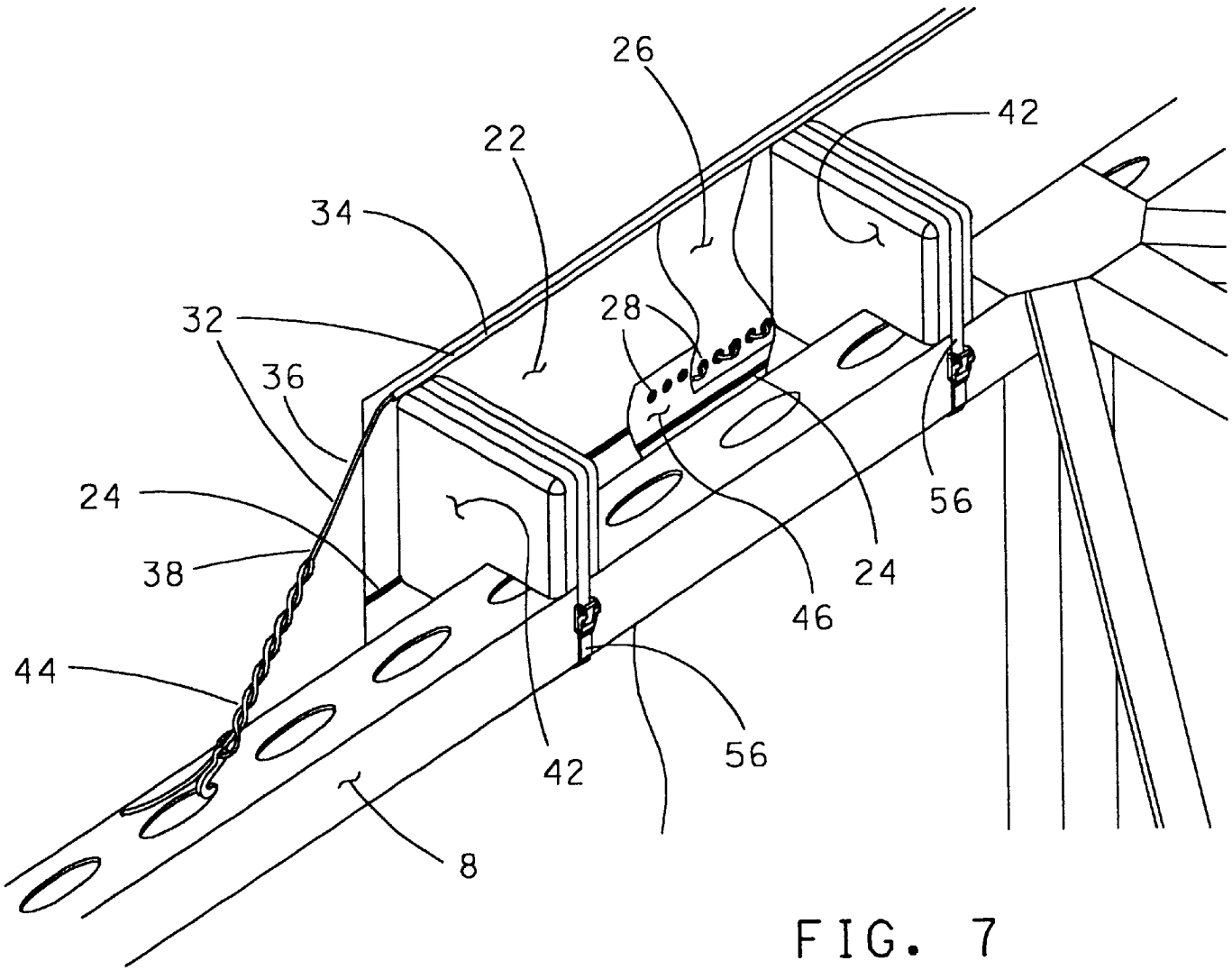
FIG. 7 is a view showing air bladders and tracking means attached to an upper outer edge of a bridge and showing some detail of the attachment means for attaching side flaps.
Figure 8:
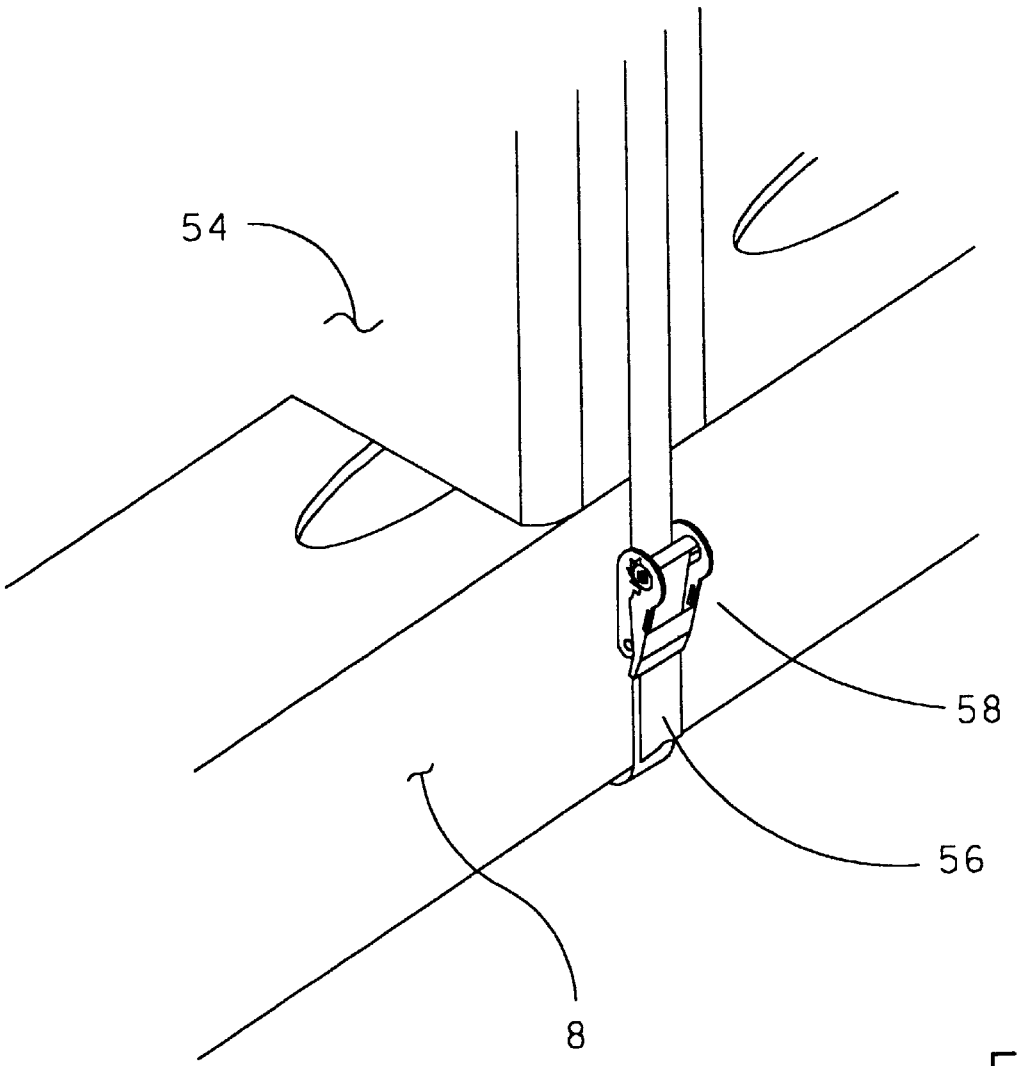
FIG. 8 is a side view showing details of a ratchet strap used for securing an air bladder to a bridge as detailed from FIG. 7.
Figure 9:
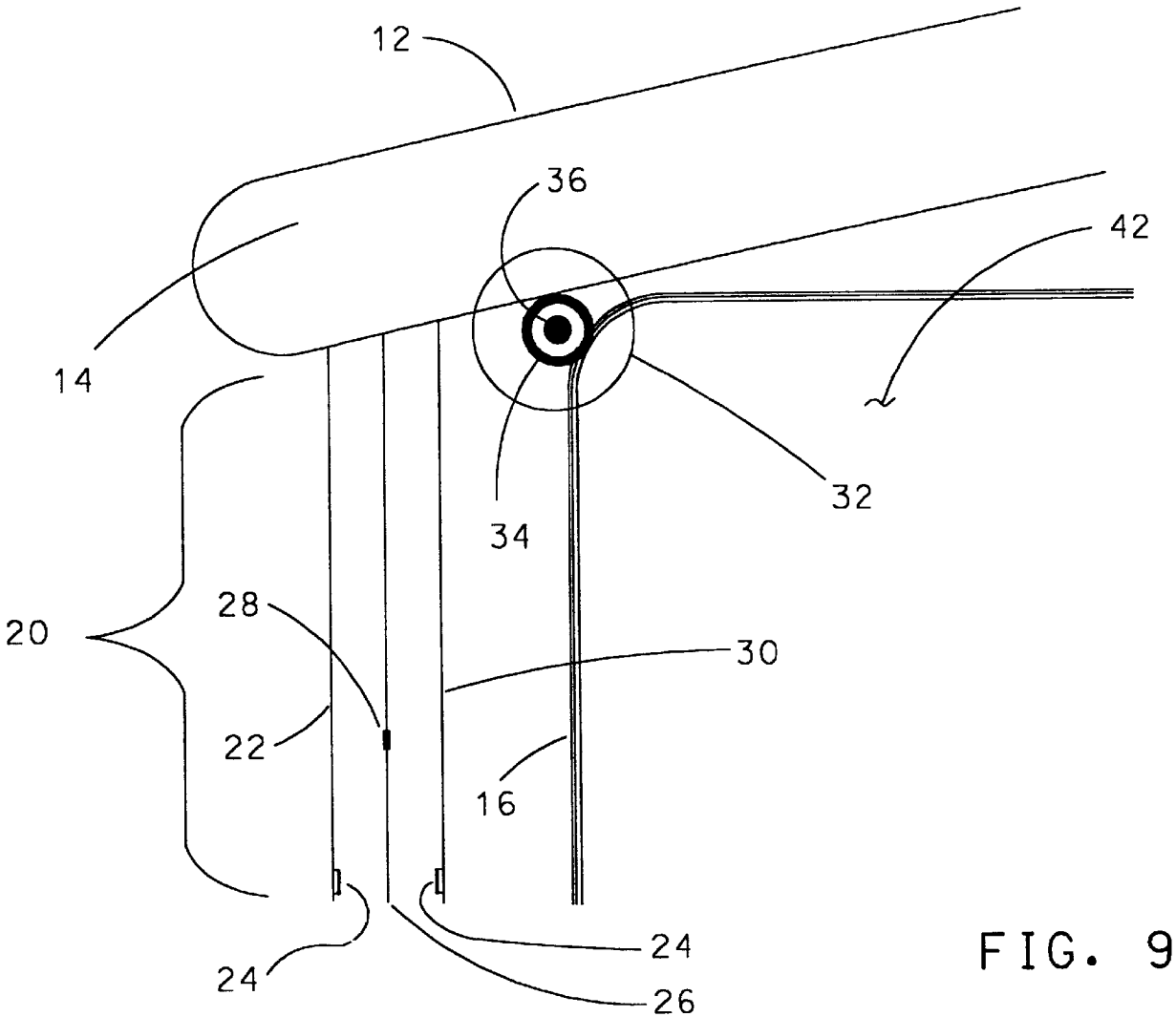
FIG. 9 is a detail view showing an end view of the tracking means, air bladder, canopy with attachment means for attachment of side and end flaps.

Referring now to the drawings in general there is shown a preferred embodiment of the containment system 10 of this invention.

The present invention includes a complete containment system 10 for enclosing a bridge or other structure, or portion thereof, to prevent escape of environmentally harmful, or potentially harmful, matter during painting, sand blasting, application of insecticides, and any other procedure on a structure that requires the structure to be enclosed to prevent escape of "contaminants." The containment system 10 uses a plurality of inflatable air bladders 42 at the corner or edges of the structure; a tracking means 32 consisting of a casing 34, made of PVC piping and cable 36 in the preferred embodiment, along an outer edge of the air bladder 42 for attachment and movement of a canopy; air inflatable air beams 14 are contained within a canopy 12 to provide structure and support to the canopy 12. The canopy has attachment provisions 20 at the sides of the canopy for attachment and sealing of side tarps 46 and 48 which cover the sides of the structure. Inflatable air bags 60 are positioned at selected locations along the sides to hold the tarps 46 and 48 outward from the side of the structure 8. Once installed the enclosure 10 is easily moved along the tracking means 32, using the casing 34 and cable 36 of the preferred embodiment. The containment system 10 is relatively light weight, easy to install, and is movable on the structure.

The containment system 10 provides an easy method of enclosing a bridge 8, as illustrated, during painting operations, contains sand blasting material during cleaning, contains paint over spray and provides protection from the weather. The canopy 12 covers a top portion of the bridge 8 as described herein. The sides of the bridge 8 are covered by tarps or side flaps 46 and 48. The bottom is enclosed with floor or bottom tarp 50. End panels or end flaps 52 enclose the ends to make a complete enclosure 10.

The preferred embodiment and the best mode contemplated of the containment system 10 of the present invention are herein described. However, it should be understood that the best mode for carrying out the invention hereinafter described is offered by way of illustration and not by the way of limitation. It is intended that the scope of the invention include all modifications that incorporate its principal design features.

The containment system 10 is a system of components working in synchronization to form an enclosure (also referred to as reference numeral 10) to contain environmental hazards generated by abrasive blasting operations. In addition to containing environmental hazards, the system significantly reduces the time required for installation and movement along the project structure.

The containment system 10, which forms an enclosure also referenced as numeral 10, is comprised of a puncture and cut resistant fabric canopy 12 with side walls 46 and 48, ends 52, and a floor 50. The canopy 12 is supported by internal thin-walled cylindrical air beams 14 and customized air bladders 42 attached to the structure 8. The containment system 8 are both held in place and moved along the structure by a tracking system 32. The tracking system 32 in the preferred embodiment consists of a wire rope 36 encased in a smooth, lightweight casing 34 attached to the structure by slip-resistant hooking mechanisms 44 attached to ends of the cable. Environmental contaminants are held within the enclosure 10 by the containment components and negative pressure created by the use of dust collectors.

A canopy 12 is made of a light weight puncture and cut resistant fabric. Usually the canopy 12 would also be water resistant and air impermeable. This would be to provide the needed water protection on the inside and to provide a generally an air secured enclosure. A dust collection system is typically used. As such, a negative pressure exists in a typical environmental containment system. Air impermeable material provides needed air resistance to control air input and air output for controlling dust collection.

Generally speaking, the canopy 12 can be made available in virtually any size, but will be sized based upon the structure to be enclosed. As an example, a canopy 12 for a bridge will be approximately ten to twelve feet wider than the bridge is wide. The extra width allows the side flaps 46 and 48 or tarps to hang downward to provide work room and clearance along the sides of the structure 8. The length of the canopy is completely dependant upon the structure to be covered and the practicality of handling. Generally, the length of canopy 12 may be such that only a portion of a large or long structure is covered, such as long bridges as illustrated, or it may completely cover a structure, such as on shorter or smaller structures.

The air beams 14 traverses the canopy 12 to provide structure and support for the canopy 12 installed over the structure 8. The air beams 14 generally traverse the canopy 12 from side to side. The air beams 14 are preferably thinned walled cylindrical air beams inflatable with pressurized air or other compressed gas. Typically, at the site they will be inflated using an air compressor. Air beams 14 can be integrated with the canopy 12 as a single unit or made as being removable. The air beams 14 can be directly attached to the canopy 12, and as such, are integrated with or are internal within the canopy 12. However, this method is not preferred. The preferred embodiment is to have traverse openings or sleeves 16 across the canopy 12, from side to side as illustrated. In this manner, the air beams 14 are inserted into the sleeves 16 or openings, and can be easily installed and removed—for shipment, erection of the enclosure, and replacement—as needed or as necessary.

Loops 18 are provided along a lower or inside surface of the canopy 12 near the side edges of the canopy 12. There can be one long loop or a plurality of smaller loops 18, as shown. These are for attaching the canopy 12 and enclosure to a tracking means 32, which allows the entire enclosure 10 to be moved along the structure 8. This is later explained in detail.

The outer perimeter of the canopy 12, in the preferred embodiment, has an attachment means 20, for attachment of side flaps 46 and 48, and end flaps 52. The attachment means 20 of the preferred embodiment has three short flaps, 22, 26 and 30. These flaps extend from the canopy 12 along the perimeter of the canopy 12. There is an outer flap 22 acting as a watershed and attachable to the side and/or end flaps 46, 48 and 52 with hook and loop material 24. The hook and loop material 24 is attached to an inside surface of the outer flap 22 to mate with the reciprocal hook and loop material 24 on an outer surface of side flaps 46 and 48, an/or with end flaps 52. A middle flap 26 has a plurality of grommets 28, or other attachment method, to actually attach and secure the side flaps 46 and 48 and/or the end flaps 52. An inside flap 30 provides an air buffer and for the canopy 12, and extra material for the canopy 12 rest upon the air bladders 42 and tracking means 32.

Another unique feature of this invention is that the entire enclosure can be easily moved along the structure 8. This has not been possible with the known prior art. Therefore, this feature alone saves considerable amounts of labor for dismantling and reassembling the enclosure as work progresses. The present invention includes a tracking means 32 for movement of the enclosure 10 along the structure 8 as the work progresses.

A tracking means 32 is installed within and extends from loops 18 on canopy 12, whether one continuous loop or a plurality of individual lops 18 as illustrated, and is attached to the structure 8 or other suitable remote location. The canopy 12 and enclosure are moveable on the tracking means 32. A smooth light weight casing 34, such as PVC piping or equivalent, is installed within the loops 18 on canopy 12. The casing 34 extends the entire length of canopy 12. A cable, wire rope, chain, rope, or equivalent, generally referred herein as a cable and reference numeral 36, extends through the casing 34 with the ends 38 and 40 being rigidly attached to the structure 8, or to some remote properly positioned location, such that the cable 36 is secured in a position parallel to outside edges of the structure. The casing 34, with canopy 12 and enclosure, is slidable along the cable 36. The ends of the cable 36 are secured in a position to allow movement along the entire length of the structure to be worked. As such the length of the cable 36 could be for the entire length of the structure or only the portion to be worked. Once the cable 36 is installed, movement is easily achieved along its entire length. The casing 34 is held in place against air bladders 42 by the canopy 12, side flaps 46 and 48, and by tension on the cable 36.

A plurality of air bladders 42 are typically used. These will be placed and secured along corners of the structure 8. There will always be at least two air bladders used on each side of the structure, one at each of the upper and outer most corners. This is a minimum. Almost always there will be more. The exact number being determined by the size of the structure and the size of the canopy being used. A bridge or other suspended structure would generally use a minimum of four to each side. There will be at least two upper and two lower air bladders 42 on each side. The air bladders 42 provide primary support for the canopy and for the entire enclosure. The air bladders 42 hang over and outward from the side of the structure to hold side and/or end flaps 46, 48 and 52 away from the structure 8 and holds the tracking means outward from and parallel to edges of the structure.

Generally, the air bladders 42 are square structures having a width inflatable with pressurized air or other gas. The air bladders 42 are dimensioned to provide side clearance between the structure and the side flaps for workers to work on sides of the structure. Preferably, the air bladder 42 have one corner notched 54 to fit onto and over edges of the structure 8 and to hold the air bladder in proper position on the structure. The air bladders 42 supports the entire enclose including the canopy 8, side flaps 46 and 48, and/or end flaps 52 in a proper position on the structure. The air bladders are secured to the structure 8 in such a manner that they are easily removed and installed.

In another embodiment, not shown, the air bladders 42 are simply foam filled. In this embodiment, the air bladders 42 retain their shape and the material of the air bladder forms a weather resistant coating over the foam. In another words, the air bladders 42 could possibly be foam forms with a weather resistant coating or layer on the outside surfaces. Air inflation is the preferred embodiment, because it provides easy storage and shipment and inflation can be used for tightening the entire enclosure and its components. But in some instances a rigid air bladder 42, such as foam filled air bladders, would be preferred because of the ability to retain its shape.

Many different methods can be used to secure the air bladders 42 to the structure. The method used would be dependant on the particulars of the structure, size of both the structure and air bladders 42 being used, and general configuration Generally, a clinching means 56, or some known or unknown securing method, is used for this purpose.

In the preferred embodiment the clinching means 56 is a common ratchet strap, (also referenced as 56). The ratchet strap 56 can be wrapped around the air bladder 42 and the structure 8, and securely tightened by a ratchet 58 on the ratchet strap 56. This provides an easy means of securing air bladders 42 to the structure, yet allowing an easy means of removing and moving the air bladder with or without deflation. Of course, adding air to the air bladders 42 increases tension on the ratchet strap 56 to further secure the air bladder 42 to the structure 8.

Any type of clinching means 56 that provides for securement and removal of the air bladders 42 is within the scope and spirit of his invention. Other examples, but not limited to, include: any strap, belt, rope, cable, or any similar or equivalent device attached to or around an air bladder 42 having a buckle, hook and loop material, D-rings, or any other means of securing together two ends of the strap, belt or whatever, can be used.

Generally the ratchet 58, buckle or other attachment or securing device will be located near the notch 56 on the corner of the air bladder 42. This allows the strap to be wrapped around the structure and secured by the ratchet 58, buckle or securing means, near the structure, rather than by the air bladder itself. This helps to prevent the ratchet 58, buckle or other attachment device from damaging the air bladder 42. Another possible clinching device would be some sort of strap, belt or whatever that is tightened or loosened by inflating or deflating the air bladders 42 as necessary to provide proper tension and securement.

Since air bladders 42 are large generally square or rectangular structures that are inflatable, the sides can bulge out during inflation. This can cause deformation of the air bladder 42 and render it inoperative for the purpose. As such, internal or external structure can be used to help maintain proper structure and form. This can include internal baffles, internal straps, or any other means to help maintain air bladder shape and to provide strength when inflated. An external bag of some sort could also be used. The bag could be rigid or soft. There could also be tubes or channels with or without openings, similar to an air mattress. The point is that there may be some sort of method used to maintain air bladder shape. Any suitable method can be used. The preferred embodiment uses internal baffles or strapping to hold the sides of the air bladders 42 at a specific distance from each other while inflated. This allows the air bladders 42 to be inflated to the proper pressure while maintaining its shape and for providing proper support for the enclosure 10.

The typical air bladder, for most uses, will have a dimension of 5 to 6 feet high, 5 to 6 feet long and a width of approximately 1 foot. The notched out area 56 will typically be 1 foot by 1 foot. This provides an overhang of four to five feet, which is suitable in most cases. However, these dimensions are only general in nature. Again the particular application, size of structure, type of work, and size of the enclosure needed would be determining factors.

Air bags 60 are used to hold the side flaps 46 and 48, and perhaps end flaps 52 out and away from the sides, front and back of the structure 8. These would be placed and used as needed. Used in combination with the overhang of the air bladders 42, work clearance for workers to work on the structure is provided. Side flaps 46 and 48 tend to be pushed inward by winds or sucked inwards by dust collectors. Air bags 60 provides an easy method of holding the flaps (46, 48 and 52) or tarps outward. These air bags 60 are easily attached using a ratchet strap or other clinching means as with the air bladders 42 and is not discussed in any detail. One skilled in the art could use any or many different types of clinching means known and used.

Side flaps 46 and 48 are generally large tarps made of a light weight, rip and tear resistant, air impermeable and water resistant material. Air impermeability is generally needed, therefore, side flaps 46 and 48 are generally made of similar air impermeable material as the canopy 12. End flaps are also provided to enclose the end openings created between the canopy 12 and ends of side flaps 46 and 48. Generally the end flaps are made just as the side flaps and may be continuous with the side flaps 46 and/or 48 in some instances. The side flaps 46 and 48 and the end flaps 52 have some sort of attachment means along the top and bottom for attachment to the canopy 12 and floor flap 50.

In the preferred embodiment, a plurality of grommets 28 are provided in rows a couple inches below and along a top and bottom edge of the tarp or flap 46, 48, 52. This allows the side flaps 46 and 48 and end flap 52 to be tied to the middle flap 26 on the attachment means of the canopy 12, in the preferred embodiment. Just below the top row of grommets, hook and loop material 24 is added to seal the outer flap 22 and inner flap 26 to the outside and inside of the side flaps respectfully. The grommets 24 provides an easy means of securing the flaps 46, 48, and 52 to the canopy and support it's weight, while the hook and loop material provides a means of controlling air and water infiltration. The preferred embodiment, using an attachment means 20 with three flaps is only the preferred method. Again, other methods could be used without departing from the scope and spirit of the invention.

The sides edges 62 of the side flaps 46 and 48 and end flaps 52 are attached together to form the enclosure over and around the structure. These are generally joined and secured to control water and air infiltration. The sides can be joined in any manner. Grommets 24 and hook and loop material can be used, but any method can be used.

A bottom tarp 50 to enclose a bottom area of a suspended structure 8, such as a bridge, is also provided. The bottom tarp 50 is similar to the canopy 12, in that it is supported by air bladders 12 and tracking means 32. However it need not include air beams 14. The side flaps 46 and 48 would be joined to the bottom flap 50 using an attachment means 20, or another similar or equivalent method, used to attach the side flaps 46 and 48 to canopy 12. They do not necessarily have to be the same. The end flaps 52 would also be attached to the bottom tarp 50 to the extent possible. For controlling air infiltration, the edge of the bottom flap 50 would normally be secured to the underside of the structure 8 or road way 4, depending on the circumstances. This could be by use of air bags 60 and/or any other method.

IN APPLICATION

To use the containment system of this invention on a bridge, an enclosure is made or put together and used as follows:

First, on bridge deck 6 insert air beams into sleeves on a canopy. Gather the canopy together like an accordion and tie in several places. Lift the canopy to top of bridge beams and thread casing or pvc pipe in outside sleeves. Thread wire cable, or equivalent, through casing. Place air bladders, one on each end of canopy. (So canopy is between the air bladders.) Inflate air bladders. Attach one end of the wire cable to the structure, or other remote location, with a slip-resistant hooking mechanism, or other device. Attach opposite end of wire cable on same side of the structure, or other remote location, with another slip-resistant hooking mechanism or other type of device. Place canopy with attached wire cable on outside corner of air bladders and apply tension to wire cable. Repeat above steps for on other side of structure. Stretch canopy until taunt. Place and secure the end air bladders. Place and secure additional air bladders where needed under canopy with PVC pipe on outside corner of air bladder.

Once the canopy is positioned and stretched, attach side flaps to form side walls. Reverse order for floor under the structure. Secure end flaps to canopy and flooring to provide end walls. Join edges of side flaps to edges of the end flaps.

The structure is now enclosed and contained, and is ready for a dust collection system to be installed.

Prior to the containment system 10 of this invention, air infiltration has always been a major problem. The tarp used were heavy, easily ripped or torn. They provided minimum amount of water resistance and where very heavy. Heavy steel and wood framing was constructed and cabling was required for support. Wind always was a major problem First, because of the weight of the tarps the wind pressure on the tarps cause bending and breakage of the frames and cables. Ripped and torn tarps were very common. In order to control dust collection, very large units had to be used to compensate for air infiltration. They had to compensate for all the air infiltration.

The containment system 10 of this invention overcomes these problems. Because the canopy and tarps are made of light weight tear resistant and water and air impermeable material air infiltration is more controllable than with previous methods. This cuts down on oversizing to compensate and will save considerable amounts of cost for larger units and their operation. Since steel and wood framing is not used or needed, tarps cannot be damages by bending and broken framing materials. Plus, there is a considerable savings in time, material, and manhours in the elimination of the framing and cabling.

Since the present system is supported by air beams and air bladders, the enclosure typically bends and flexes with the wind. The air bags, and air bladders actually help protect the tarps from being ripped or torn by the structure. If properly installed, once the wind dies down the air bladders and air beams return the tarps and canopy back to the original pre-wind position. Again saving considerable amounts of time and material for replacing and repairing enclosures. Overall, the containment system 10 of this invention saves considerable amounts of time in may areas. There are no framing and cabling. No heavy tarps used. Vast reduction in wind damage. Ease of installation, No disassembling and reassembling for movement of the enclosure on the structure. Easier to transport and store. Controlled air infiltration and reduction in sizing dust collectors.

As described, the present invention over comes and solves many problems associated with the prior art.

Having described the invention in detail, those skilled in the art will appreciate that modifications may be made of the invention without departing from the spirit of the inventive concept herein described.

Therefore, it is not intended that the scope of the invention be limited to the specific and preferred embodiments illustrated and described. Rather, it is intended that the scope of the invention be determined by the appended claims and their equivalents.

What is claimed is:

1. A containment system to enclose a structure for entrapment of contaminants or other potentially harmful material comprising:

a canopy to cover a portion of or an entire top area of a structure;

air beams attached to said canopy, internal to said canopy, or contained within sleeves on said canopy to support said canopy over said structure; said air beams traversing said canopy from side to side;

one or more loops attached along a lower side of said canopy near side edges of said canopy;

a tracking means installed within and extending from one or more of said loops on said canopy, said canopy being moveable on said tracking means;

side flaps attached to and extending downward from side edges of said canopy, said side flaps enclosing and covering sides of said structure;

end flaps attached to and extending downward from end edges of said canopy, said end flaps enclosing and covering open ends defined between said side flaps and canopy, side edges of said end flaps attached to side edges on said side flaps, thereby providing an enclosure over and around said structure;

a plurality of air bladders attached to uppermost edges of said structure, and/or lower most edges if said structure is suspended, said air bladders holding said canopy and/or side and/or end flaps away from said structure and holding said tracking means outward from said uppermost edge of said structure; and one or more air bags secured to said structure or to an inside surface of said side flaps and/or end flaps to hold said side flaps and/or said end flaps away from said structure to provide clearance and working room between said structure and said structure.

2. The containment system as set forth in claim 1 further comprising a bottom tarp to enclose a bottom area of a suspended structure, sides edges of said bottom tarp attached to a lower edge of said side flaps and end edges either secured against a bottom of said structure or attached to lower edges of said end flaps.

3. The containment system as set forth in claim 1 further comprising an attachment means to attach said side flaps and/or said end flaps to said canopy.

4. The containment system as set forth in claim 3 in which said attachment means comprise three flaps extending from perimeter edges of said canopy, said three flaps comprising an outer flap acting as a watershed and attached to said side and/or end flaps with hook and loop material; a middle flap having a plurality of grommets, or other attachment method, to attach said side flaps and/or said end flaps; and an inside flap to provide an air buffer and for said canopy to rest upon said air bladders and tracking means.

5. The containment system as set forth in claim 1 in which said tracking means comprise a smooth light weight casing such as PVC piping, or equivalent, installed within said loops on said canopy; a cable, wire rope, chain, rope, or equivalent, extending through said casing with ends of said cable, wire rope, chain, rope, or equivalent, rigidly attached to said structure, or remote location, such that said cable, wire rope, chain, or equivalent is secured in a position parallel to outside upper edges of said structure; said casing slidable along said cable, wire rope, chain, or equivalent, to provide movement of said enclosure, consisting of said canopy, side flaps, and/ or end flaps, along said structure, and said ends of said cable, wire rope, chain, or equivalent secured in a position to allow movement along a length of said structure to be worked; and said casing being held in place against said air bladders by said canopy, side flaps, and by tension on said cable, wire rope, chain, rope, or equivalent.

6. The containment system as set forth in claim 1 in which said air bladders comprise a generally square inflatable structure having a width, inflatable with pressurized air or other gas, dimensioned to provide side clearance between said structure and said side flaps for workers to work on sides of said structure, said air bladder having one corner notched to fit onto and over edges of said structure and to hold said air bladder in proper position on said structure, said air bladders supporting said canopy, side flaps, and/or end flaps in a proper position on said structure, and said air bladders being secured, but removable, to said structure by a clinching means.

7. The containment system as set forth in claim 6 in which said clinching means comprises a ratchet strap which can be wrapped around said air bladder and on said structure, and securely tightened by a ratchet on said ratchet strap to secure said air bladder to said structure, said ratchet strap providing an easy means of removing and moving said air bladder with or without deflation.

8. The containment system as set forth in claim 5 in which said clinching means comprises a strap attached around said air bladder having a buckle or other means of securing together two ends of said strap, said buckle, or other securing means, generally located near said notch on corner of said air bladder, said strap being wrappable around said structure and secured by said buckle or securing means, said air bladder can be inflated or deflated as necessary to provide proper tension on said strap to secure said air bladder in position on said structure and to provide proper support for said containment system.

9. The containment system as set forth in claim 6 in which said air bladder has internal baffles, internal straps, or other means to maintain air bladder shape and to provide strength when inflated.

10. A containment system to enclose a structure for entrapment of contaminants or other potentially harmful material comprising:

a canopy having inflatable air beams traversing said canopy to support said canopy, said canopy covering a portion of or an entire top area of a structure, one or more loops attached to an under side of said canopy near side edges of said canopy, and an attachment means along perimeter edges of said canopy;

a smooth casing such as PVC piping, or equivalent, installed within said loops on said canopy; a cable, wire rope, chain, rope, or equivalent, extending through said casing with ends of said cable, wire rope, chain, rope, or equivalent, rigidly attached to said structure, or remote location, such that said cable, wire rope, chain, or equivalent is secured in a position parallel to outside upper edges of said structure; said casing slidable along said cable, wire rope, chain, or equivalent, to provide movement of said canopy along said structure, and said ends of said cable, wire rope, chain, or equivalent secured in a position to allow movement along a length of said structure to be worked;

side flaps attached to and extending downward from said attachment means on said canopy, said side flaps enclosing and covering sides of said structure;

end flaps attached to and extending downward from said attachment means on said canopy, said end flaps enclosing and covering open ends defined between said side flaps and canopy, side edges of said end flaps attached to side edges on said side flaps, thereby providing an enclosure over and around said structure;

a plurality of air bladders attached to uppermost edges of said structure, and/or lower most edges if said structure is suspended, said air bladders holding said canopy and/or side and/or end flaps away from said structure and holding said tracking means outward from said uppermost edge of said structure; said casing being held in place against said air bladders by said canopy, side flaps, and by tension on said cable, wire rope, chain, rope, or equivalent; and one or more air bags secured to said structure or to an inside surface of said side flaps and/or end flaps to hold said side flaps and/or said end flaps away from said structure to provide clearance and working room between said structure and said structure.

11. The containment system as set forth in claim 10 further comprising a bottom tarp to enclose a bottom area of a suspended structure, sides edges of said bottom tarp attached to a lower edge of said side flaps and end edges either secured against a bottom of said structure or attached to lower edges of said end flaps.

12. The containment system as set forth in claim 10 in which said attachment means comprise three flaps extending from perimeter edges of said canopy, said three flaps comprising an outer flap acting as a watershed and attached to said side and/or end flaps with hook and loop material; a middle flap having a plurality of grommets, or other attachment method, to attach said side flaps and/or said end flaps; and an inside flap to provide an air buffer and for said canopy to rest upon said air bladders and tracking means.

13. A containment system to enclose a structure for entrapment of contaminants or other potentially harmful material comprising:

a canopy supported with air beams that cover a portion of or an entire top area of a structure;

side flaps attached to and extending downward from side edges of said canopy, said side flaps enclosing and covering sides of said structure;

end flaps attached to and extending downward from end edges of said canopy, and side edges of said side flaps to enclose and cover open ends defined between said side flaps and canopy, thereby providing an enclosure over and around said structure; and a plurality of air bladders attached to uppermost edges of said structure, said air bladders supporting and holding said canopy, side flap and end flaps away from said structure.

14. The containment system as set forth in claim 13 further comprising one or more air bags secured to said structure or to an inside surface of said side flaps and/or end flaps to hold said side flaps and/or said end flaps away from said structure to provide clearance and working room between said structure and said structure.

15. The containment system as set forth in claim 13 further comprising a tracking means secured to said air bladders parallel to outer edges of said structure, said tracking means providing a means of moving said enclosure along said structure.

16. The containment system as set forth in claim 13 in which said air bladders are foam forms which may include a weather resistant coating or layer to protect said foam forms.

17. The containment system as set forth in claim 13 further comprising a bottom tarp, said bottom tarp having side edges attached to lower edges of said side flaps and end edges being secured to a lower surface of said structure and/or to lower edges of said end flaps, to thereby form a complete enclosure over and around a suspended structure.

* * * * *